US009051764B1

(12) United States Patent
Rafter et al.

(10) Patent No.: US 9,051,764 B1
(45) Date of Patent: Jun. 9, 2015

(54) INTERNAL ROTATIONAL LOCKING MECHANISM

(75) Inventors: Ryan P. Rafter, Burlingame, CA (US); Sukwon Noh, Cupertino, CA (US)

(73) Assignee: Amazon Technologies, Inc., Reno, NV (US)

( * ) Notice: Subject to any disclaimer, the term of this patent is extended or adjusted under 35 U.S.C. 154(b) by 232 days.

(21) Appl. No.: 13/529,791

(22) Filed: Jun. 21, 2012

(51) Int. Cl.
*E05C 19/16* (2006.01)
*E05C 17/56* (2006.01)

(52) U.S. Cl.
CPC ..... *E05C 17/56* (2013.01)

(58) Field of Classification Search
CPC ..... E05C 10/16
USPC ..... 292/251.5
See application file for complete search history.

(56) References Cited

U.S. PATENT DOCUMENTS 4,099,755 A * 7/1978 Anderson ..... 292/251.5
5,485,733 A * 1/1996 Hoffman ..... 70/276
8,368,494 B2 * 2/2013 Fiedler ..... 335/285

* cited by examiner

*Primary Examiner* — Mark Williams
(74) *Attorney, Agent, or Firm* — Lowenstein Sandler LLP

(57) ABSTRACT

An internal rotational locking device prevents separation of a front cover and a rear cover of a user device. The internal rotational locking device includes a rotational bracket coupled to the rear cover. The rotational bracket includes a locking tab to overhang a locking edge of the front cover. The internal rotational locking device further includes a compression spring to maintain a distance between the rotational bracket and the rear cover. The internal rotational locking device further includes a torsion spring to maintain a first rotational position of the rotational bracket, where the locking tab overhangs the locking edge in the first rotational position.

17 Claims, 5 Drawing Sheets

INTERNAL ROTATIONAL LOCKING MECHANISM

BACKGROUND

Many devices, such as user electronic devices (e.g., tablet computers, smartphones, etc.) or other devices, include an exterior cover. Often, this exterior cover includes two or more pieces (e.g., a front cover and a rear cover) that connect together to form the exterior of the device. It certain cases, it is desirable to be able to separate the front cover and rear cover in order to access the internal portion of the device (e.g., for repair or replacement of the internal electronics, batteries, etc.). While able to be separated, the cover pieces should generally remain connected together during normal use of the device.

There may be a number of different fasteners used to secure the front cover and the back cover of the device together. For example, there may be multiple friction-based snaps, clasps or tabs, internal to the device, that hold the covers together. As these fasteners are designed to be overcome with a minimal amount of force, the likelihood of the fasteners becoming unintentionally opened or undone is high. This is especially true, for example, in a situation where the device is dropped or otherwise jarred.

BRIEF DESCRIPTION OF DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1:
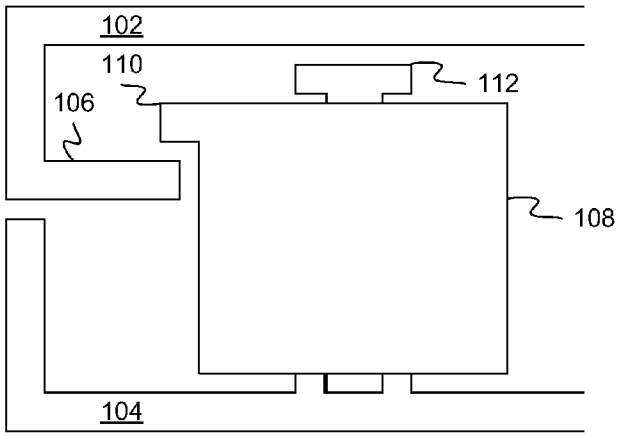
FIG. 1 is a block diagram illustrating a side view of an internal rotational locking mechanism, according to an embodiment.

The following description sets forth numerous specific details such as examples of specific systems, components, methods, and so forth, in order to provide a good understanding of several embodiments of the present invention. It will be apparent to one skilled in the art, however, that at least some embodiments of the present invention may be practiced without these specific details. In other instances, well-known components or methods are not described in detail or are presented in simple block diagram format in order to avoid unnecessarily obscuring the present invention. Thus, the specific details set forth are merely exemplary. Particular implementations may vary from these exemplary details and still be contemplated to be within the scope of the present invention.

Embodiments of an apparatus and method are described for an internal rotational locking mechanism. In one embodiment, the internal rotational locking mechanism may function as a secondary or back-up lock to prevent a front cover and a rear cover of a user device from separating. The user device may be, for example, a user electronic device, such as an electronic book reader, cellular telephone, smartphone, personal digital assistant (PDA), portable media player, tablet computer, netbook, desktop computer, notebook computer, or the like. The front cover and the rear cover may connect together to form an exterior cover of the user device. A number of different fasteners may be used as a primary means to secure the front cover and the back cover of the user device together. For example, there may be multiple friction-based snaps, clasps or tabs that hold the covers together. Since these fasteners are designed to be overcome with a minimal amount of force, the likelihood if the fasteners becoming unintentionally opened or undone is high. In one embodiment, the internal rotational locking mechanism (or device) prevents separation of the front cover and the rear cover in the event of the user device being dropped or otherwise jarred. In another embodiment, the internal rotational locking mechanism is the primary means to secure the front cover and the back cover of the user device together.

In one embodiment, the internal rotational locking mechanism includes a rotational bracket connected internally to the rear cover. The rotational bracket may include a locking tab that overhangs a locking edge on the front cover when the locking mechanism is in the locked position. A torsion spring may hold the rotational bracket in the locked position so that the locking tab overhangs the locking edge, preventing separation of the front and rear covers. The rotational bracket may include one or more magnets so that it may be rotated using a magnetic tool in proximity to the front cover of the user device. The rotation may overcome a force applied by the torsion spring to rotate the rotational bracket into an unlocked or open position. In the unlocked position, the locking tab may no longer overhang the locking edge, so that the front cover and rear cover may be freely separated (assuming any primary fasteners have also been overcome). In one embodiment, the torsion spring may return the rotational bracket to the locked rotational position once the magnetic tool is removed from proximity to the front cover of the user device.

The internal rotational locking mechanism described herein securely prevents separation of the front and rear covers of the user device in which it is implemented. The mechanism also allows for separation in order to access the internal portion of the user device (e.g., for repair or replacement of the internal electronics, batteries, etc.) when the magnetic tool is used. In addition, the internal rotational locking mechanism is completely internal to the user device, saving valuable space on the external cover and maintaining a pleasing aesthetic quality for the device cover.

FIG. 1 is a block diagram illustrating a side view of an internal rotational locking mechanism, according to an embodiment. The mechanism may be designed to prevent separation of a front cover 102 and a rear cover 104 of a user device. In one embodiment, the mechanism includes a rotational bracket 108 that is connected to the rear cover 104 of the user device. The rotational bracket 108 may be connected to the rear cover 104 using shoulder screw 112, and rotational bracket 108 may be able to rotate freely around shoulder screw 112. In other embodiments, some other means may be used to connect rotational bracket 108 to the rear cover 104. In one embodiment, rotational bracket 108 includes a locking tab 110 extending horizontally out from a portion of rotational bracket 108. When rotational bracket 108 is in a locked position (as shown in FIG. 1), the locking tab 110 may overhang a locking edge 106 of front cover 102. Since the rotational bracket 108 is connected to rear cover 104, the overhang of locking edge 106 by locking tab 110 may prevent a separation of front cover 102 and rear cover 104. In other embodiments, rotational bracket 108 may be connected to front cover 102 and rear cover 104 may instead include a locking edge. The functionality of the locking mechanism would remain the same, so for ease of explanation, additional description of the locking mechanism will be with reference to the arrangement shown in FIG. 1.

Figure 2:
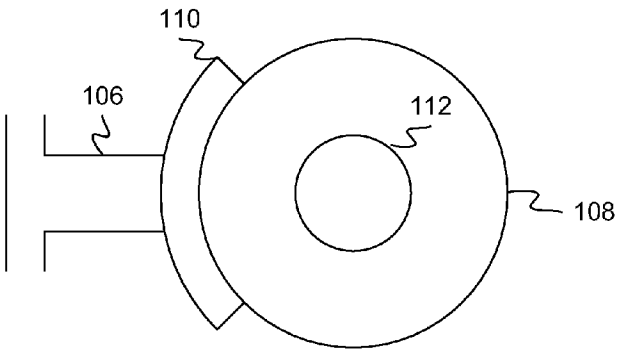
FIG. 2 is a block diagram illustrating a top view of an internal rotational locking mechanism, according to an embodiment.

FIG. 2 is a block diagram illustrating a top view of an internal rotational locking mechanism, according to an embodiment. In one embodiment, rotational bracket 108 is substantially cylindrical in shape, allowing for an ease of rotation around shoulder screw 112. In other embodiments, rotational bracket 108 may have some other shape, provided sufficient clearance is present to allow for rotation. As discussed above, in the locked position, locking tab 110 overhangs locking edge 106 of front cover 102. In one embodiment, locking tab 110 is semi-circular in shape, protruding from the edge of rotational bracket 108, for a portion of the circumference of rotational bracket 108. In other embodiments, locking tab 110 may have some other shape, again provided there is sufficient clearance to allow rotational bracket 108 and locking tab 110 to rotate into an unlocked position. In another embodiment, locking edge 106 is also semi-circular in shape and may be similar in size to locking tab 110 to allow for maximum overhang between locking tab 110 and locking edge 106. In one embodiment, both locking edge 106 and locking tab 110 may have a radius that is the same or similar to a radius of a curved corner of the front cover 102 of the user device.

Figure 3:
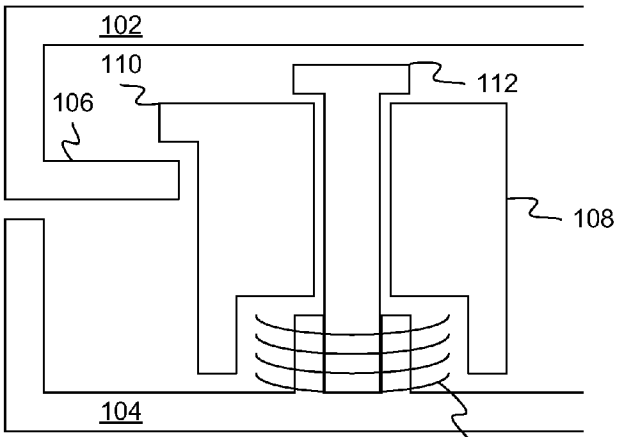
FIG. 3 is a block diagram illustrating a side cut-away view of an internal rotational locking mechanism, according to an embodiment.

FIG. 3 is a block diagram illustrating a side cut-away view of an internal rotational locking mechanism, according to an embodiment. The cut-away view illustrates how, in one embodiment, shoulder screw 112 extends approximately through the center of rotational bracket 108 and connects with rear cover 104. Shoulder screw 112 may include threads (not shown) that lock shoulder screw 112 into place with corresponding threads (not shown) in rear cover 104. In one embodiment, locking mechanism may include compression spring 114 designed to maintain a distance between the rotational bracket 108 and the rear cover 104. Compression spring 114 may also wrap around shoulder screw 112 and may reside in a chamber within rotational bracket 108. In another embodiment, compression spring 114 may reside entirely below rotational bracket 108. Compression spring 114 holds rotational bracket 108 slightly above rear cover 104, such that there is a small gap between locking tab 110 and locking edge 106. This small gap is designed to allow free rotation of rotational bracket 108 about shoulder screw 112 without having to overcome friction between locking tab 110 and locking edge 106. In other embodiments, some other means, such as for example ball bearings, may be used in place of or in addition to compression spring 114 to maintain the distance between rotational bracket 108 and rear cover 104. In other embodiments, there may be no gap between locking tab 110 and locking edge 106, such that locking tab 110 and locking edge 106 are in direct contact. This may be, for example, in devices where the internal rotational locking mechanism is the primary means for securing the front cover 102 and the rear cover 104 of the user device.

Figure 4:
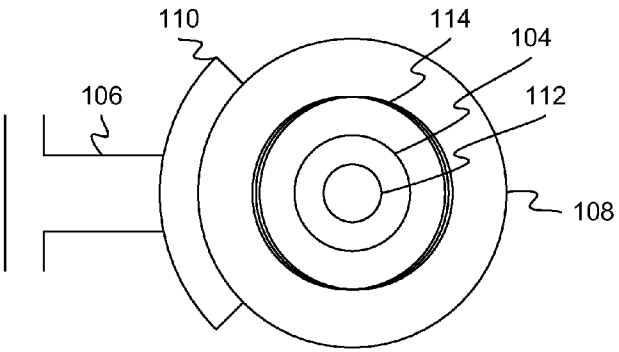
FIG. 4 is a block diagram illustrating a top cut-away view of an internal rotational locking mechanism, according to an embodiment.

FIG. 4 is a block diagram illustrating a top cut-away view of an internal rotational locking mechanism, according to an embodiment. In one embodiment, compression spring 114 is substantially cylindrical in shape, just as is rotational bracket 108. In other embodiments, compression spring 114 may have some other shape, provided sufficient clearance is present to allow for rotation of rotational bracket 108. In one embodiment, compression spring 114 may rotate in synchronization with rotational bracket 108. In other embodiments, however, compression spring 144 may be fixed in place and rotational bracket 108 may rotate freely around compression spring 114.

Figure 5:
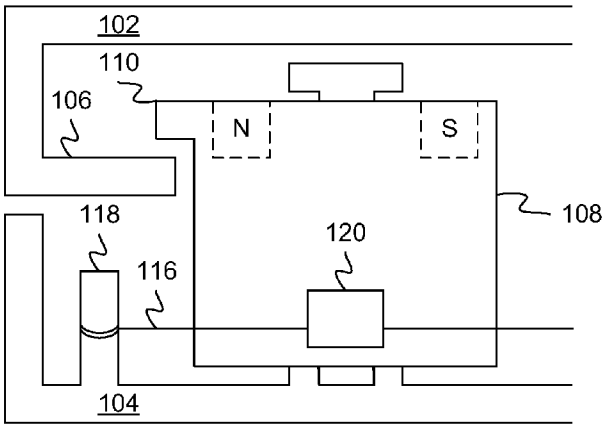
FIG. 5 is a block diagram illustrating a side view of an internal rotational locking mechanism in a locked position, according to an embodiment.

FIG. 5 is a block diagram illustrating a side view of an internal rotational locking mechanism in a locked position, according to an embodiment. In one embodiment, the internal rotational locking mechanism includes a torsion spring 116 to maintain rotational bracket 108 in the locked position, with locking tab 110 overhanging locking edge 106 of front cover 102. In one embodiment, torsion spring 116 is a flexible elastic spring that stores mechanical energy when twisted. Torsion spring 116 may be formed, for example, from metal, rubber, or some other material. In one embodiment, torsion spring 116 is connected to a peg 118 extending from the interior surface of rear cover 104. Torsion spring 116 may apply a force to a rib 120 on rotational bracket 108 that the torsion spring 116 contacts. The force applied to rib 120 by torsion spring 116 prevents rotational bracket 108 from rotating unintentionally. If rotational bracket 108 attempted to rotate (e.g., due to gravity or some other force) into the unlocked position, the force applied by torsion spring 116 would keep rotational bracket 108 in the locked position, so that locking tab 110 continues to overhang locking edge 106. In other embodiments, some other means besides torsion spring 116, may be used to maintain the position of rotational bracket 108.

Figure 6:
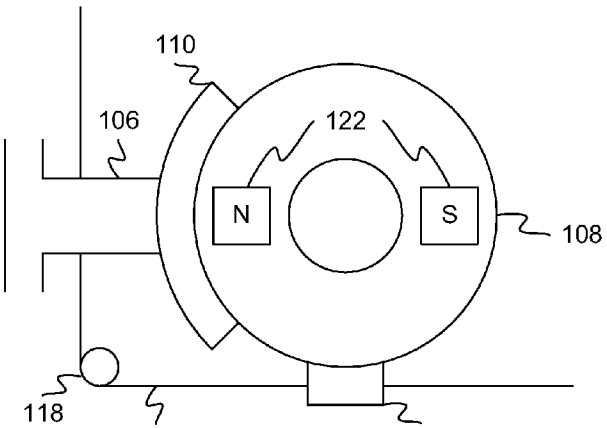
FIG. 6 is a block diagram illustrating a top view of an internal rotational locking mechanism in a locked position, according to an embodiment.

FIG. 6 is a block diagram illustrating a top view of an internal rotational locking mechanism in a locked position, according to an embodiment. In one embodiment, rotational bracket 108 includes one or more magnets 122. The magnets 122 may be embedded within rotational bracket 108 or may be attached to the exterior of rotational bracket 108. In either case, the magnets 122 may be fixed to rotational bracket 108, so that they rotate with rotational bracket 108. As will be described below, a magnetic tool may interact with magnets 122 to rotate rotational bracket 108 from the locked position to an unlocked position by counteracting the force applied to rib 120 by torsion spring 116. The figures, including FIG. 6, illustrate two magnets of opposite polarities (i.e., North and South) embedded within rotational bracket 108. It should be understood, however, that in other embodiments some other number or configuration of magnets may be used.

Figure 7:
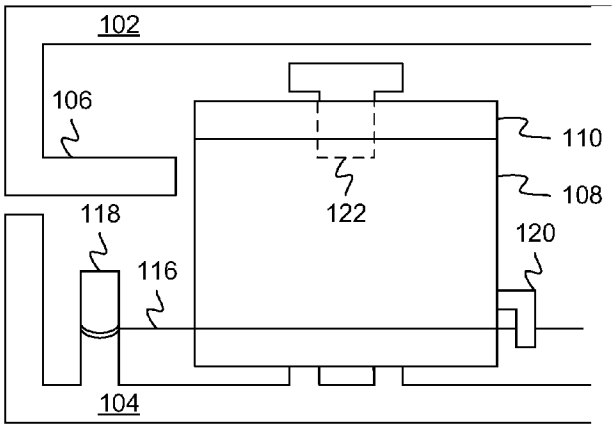
FIG. 7 is a block diagram illustrating a side view of an internal rotational locking mechanism in an unlocked position, according to an embodiment.

FIG. 7 is a block diagram illustrating a side view of an internal rotational locking mechanism in an unlocked position, according to an embodiment. In this embodiment, rotational bracket 108 is rotated into the unlocked position such that locking tab 110 is no longer overhanging locking edge 106. Assuming that any other fasteners have been undone, front cover 102 and rear cover 104 may be separated with the locking mechanism in this position. In this embodiment, the force applied to rib 120 by torsion spring 116 has been sufficiently overcome, in order to allow for the rotation of rotational bracket 108.

Figure 8:
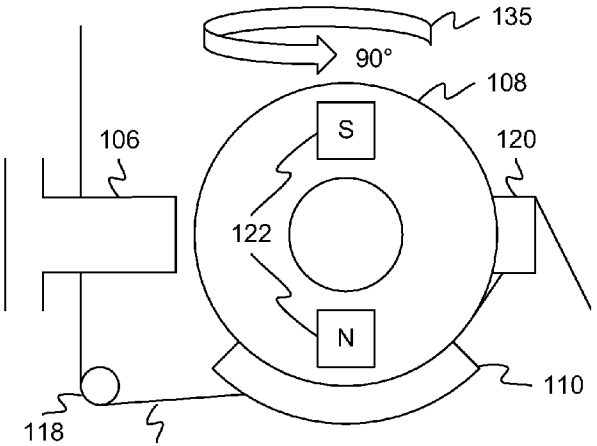
FIG. 8 is a block diagram illustrating a top view of an internal rotational locking mechanism in an unlocked position, according to an embodiment.

FIG. 8 is a block diagram illustrating a top view of an internal rotational locking mechanism in an unlocked position, according to an embodiment. In one embodiment, rotational bracket 108 is rotated 135 approximately 90 degrees in order to shift from the locked position to the unlocked position. The amount of rotation needed to reach the unlocked position may depend on the size and shape of locking tab 110 and locking edge 106. Accordingly, it should be recognized that in other embodiments, the degree of rotation to shift from the locked position to the unlocked position, or vice versa, may vary. In the embodiment illustrated in FIG. 8, rotational bracket 108 is rotated in a counter-clockwise direction to reach the unlocked position. It should be understood that, in other embodiments, rotational bracket 108 may be rotated in a clockwise direction to reach the unlocked position and the function of the locking mechanism will remain substantially the same.

Figure 9:
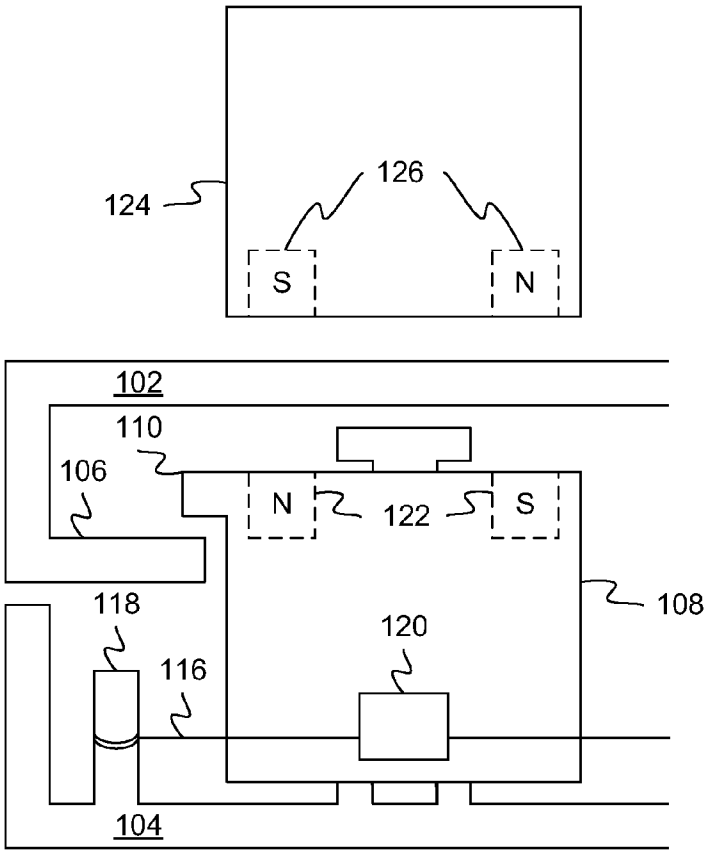
FIG. 9 is a block diagram illustrating a side view of an internal rotational locking mechanism in a locked position and a magnetic tool, according to an embodiment.

FIG. 9 is a block diagram illustrating a side view of an internal rotational locking mechanism in a locked position and a magnetic tool, according to an embodiment. In one embodiment, magnetic tool 124 may be used to interact with magnets 122 in rotational bracket 108 to rotate rotational bracket 108 from the locked position to the unlocked position or vice versa. In one embodiment, magnetic tool 124 may contain one or more magnets 126. The magnets 126 may be embedded within magnetic tool 124 or may be attached to the exterior of magnetic tool 124. The figures, including FIG. 9, illustrate two magnets of opposite polarities (i.e., North and South) embedded within magnetic tool 124. It should be understood, however, that in other embodiments some other number or configuration of magnets may be used. When magnetic tool 124 is placed in proximity to front cover 102, the magnets 126 in magnetic tool 124 may interact with magnets 122 in rotational bracket 108. The magnets 126 and 122 may form a magnetic coupling, such that when magnetic tool 124 is rotated, the magnetic coupling will cause rotational bracket 108 to rotate as well.

Figure 10:
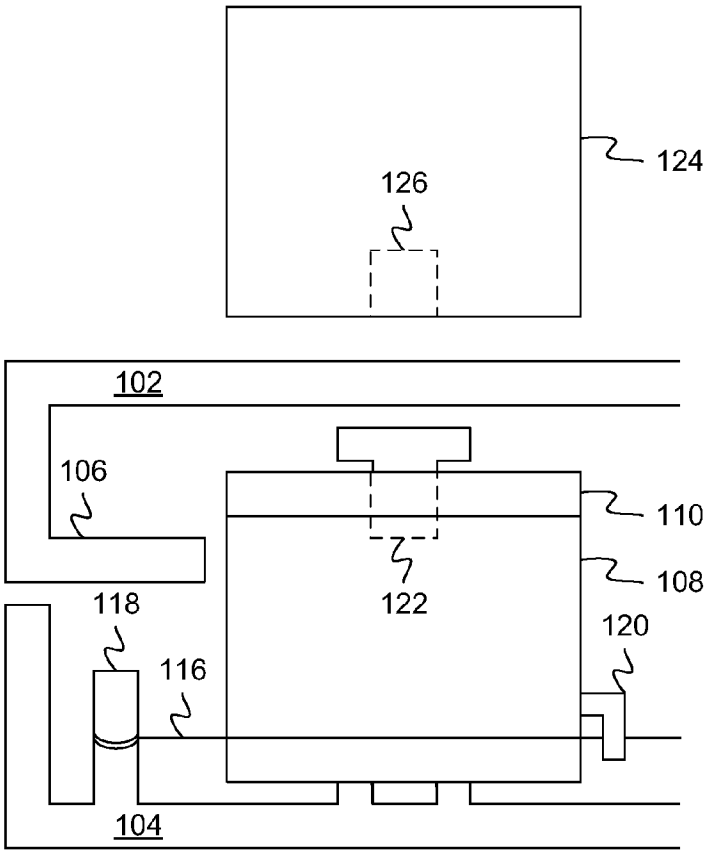
FIG. 10 is a block diagram illustrating a side view of an internal rotational locking mechanism in an unlocked position and a magnetic tool, according to an embodiment.

FIG. 10 is a block diagram illustrating a side view of an internal rotational locking mechanism in an unlocked position and a magnetic tool, according to an embodiment. In this embodiment, magnetic tool 124 has been rotated approximately 90 degrees causing rotational bracket 108 to similarly rotate from the locked position to an unlocked position, such that locking tab 110 no longer overhangs locking edge 106 of front cover 102. The force with which tool 102 (and rotational bracket 108) is rotated is sufficiently strong to overcome the force applied by torsion spring 116 to rib 120 of rotational bracket 108. Once tool 102 is removed from proximity to the front cover 102 of the user device, the force from the torsion spring 116 may be sufficient to rotate rotational bracket 108 back to the locked position, such that locking tab 110 again overhangs locking edge 106 of front cover 102.

Figure 12:
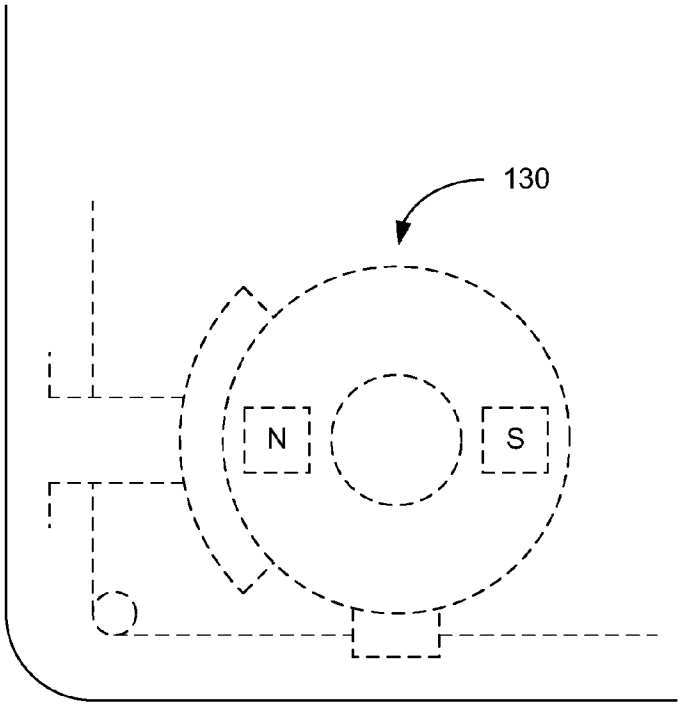
FIG. 12 is a block diagram illustrating the position of an internal rotational locking mechanism beneath an exterior cover of a user device, according to an embodiment.
Figure 11:
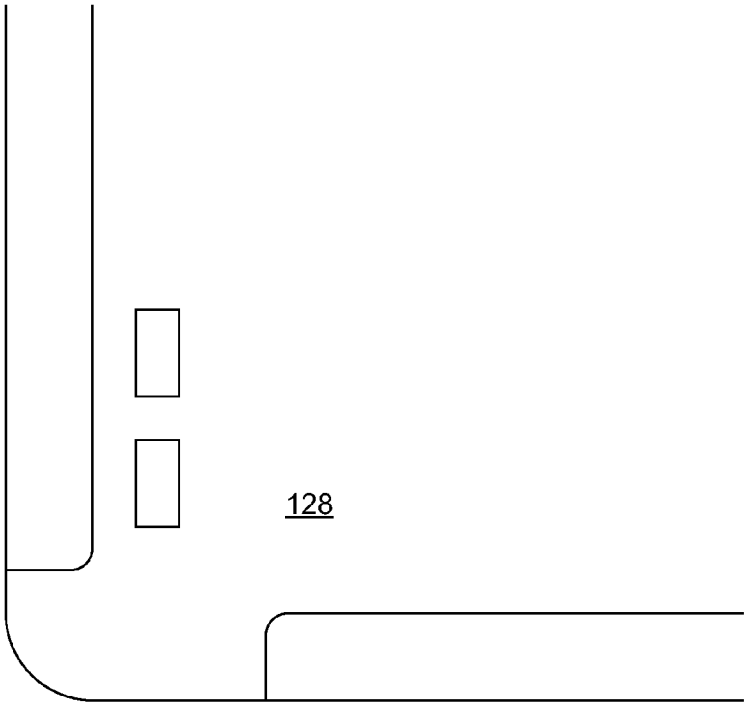
FIG. 11 is a block diagram illustrating an exterior cover of a user device, according to an embodiment.

FIG. 11 is a block diagram illustrating an exterior cover of a user device, according to an embodiment. In one embodiment, the illustrated cover 128 may be representative of either front cover 102 or rear cover 104, as described above. FIG. 12 is a block diagram illustrating the position of an internal rotational locking mechanism beneath an exterior cover of a user device, according to an embodiment. In one embodiment, the internal rotational locking mechanism 130 is located in one corner of the user device, beneath the cover 128 shown in FIG. 11. The internal rotational locking mechanism 130 may include, for example, rotational bracket 108, compression spring 114, and torsion spring 116, as described above. In one embodiment, one mechanism 130 may be located in a single corner on the interior of the user device. In other embodiments, mechanism 130 may be located elsewhere on the interior of the user device, such as in the middle of the user device or on one side of the user device. In other embodiments, there may be multiple mechanisms 130 located in various places throughout the interior of the user device, such as in multiple corners of the user device, or in other locations.

Figure 13:
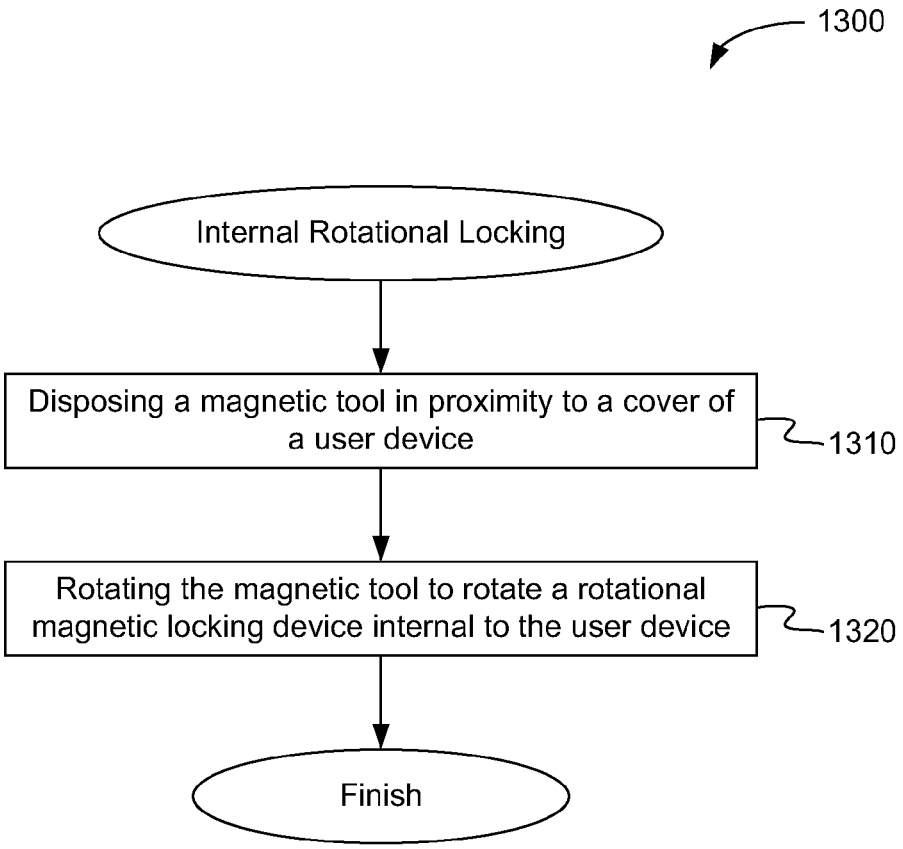
FIG. 13 is a flow diagram illustrating an internal rotational locking method, according to an embodiment.

FIG. 13 is a flow diagram illustrating an internal rotational locking method, according to an embodiment of the present invention. The method 300 may be performed by the internal rotational locking mechanism and magnetic tool described above with respect to FIGS. 1-12. In one embodiment, the internal rotational locking method prevents separation of a front cover and a rear cover of a user device.

Referring to FIG. 13, at block 1310, method 1300 disposes a magnetic tool 124 in proximity to a front cover 102 of a user device. The magnetic tool may include one or more magnets 126 designed to form a magnetic coupling with an internal rotational magnetic locking mechanism beneath the front cover 102 and internal to the user device. In one embodiment, the magnetic tool 124 may be in contact with the front cover 102. In other embodiments, the magnetic tool 124 may be disposed within a range of approximately less than three centimeters from the front cover 102. The distance between magnetic tool 124 and front cover 102 may vary depending on the strength of the magnets 126.

At block 1320, method 300 rotates the magnetic tool 124 to rotate the rotational magnetic locking mechanism internal to the user device. Rotating the magnetic tool 124 and the rotational magnetic locking mechanism in a first direction may activate the rotational magnetic locking mechanism to prevent separation of the front cover 102 and the rear cover 104 of the user device. Rotating the magnetic tool 124 and the rotational magnetic locking mechanism in a second, opposite, direction may deactivate the rotational magnetic locking mechanism to allow separation of the front cover and the rear cover of the user device. By deactivating the rotational magnetic locking mechanism, method 300 may rotate a rotational bracket 108 coupled to the rear cover 104 into an unlocked position, such that a locking tab 110 coupled to the rotational bracket 108 does not overhang a locking edge 106 of the front cover 102 of the user device.

In the above description, numerous details are set forth. It will be apparent, however, to one of ordinary skill in the art having the benefit of this disclosure, that embodiments of the invention may be practiced without these specific details. In some instances, well-known structures and devices are shown in block diagram form, rather than in detail, in order to avoid obscuring the description.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A user device comprising:

a front cover;

a rear cover, wherein the front cover and the rear cover define an interior space of the user device; and a locking device operatively coupled within the interior space of the user device to prevent unintentional separation of the front cover and the rear cover, the locking device comprising:

a rotational bracket coupled to the rear cover, the rotational bracket comprising a locking tab to overhang a locking edge on an internal surface of the front cover, wherein the rotational bracket is rotatable between a first rotational position and a second rotational position, wherein the front cover and the rear cover are locked together in the first rotational position and unlocked in the second rotational position;

a compression spring to cause a distance to be maintained between the rotational bracket and the rear cover;

a torsion spring to cause the rotational bracket to be held at the first rotational position, wherein the locking tab is engaged to the locking edge at the first rotational position to prevent separation of the front cover and the rear cover; and a magnet coupled to the rotational bracket, the magnet configured to cause the rotational bracket to rotate to the second rotational position upon being engaged by a magnetic tool external to the user device, wherein the second rotational position causing the locking tab to disengage from the locking edge to allow separation of the front cover and the rear cover.

2. The user device of claim 1, wherein the locking device further comprises:

a shoulder screw to couple the rotational bracket to the rear cover, the rotational bracket to rotate around the shoulder screw.

3. The user device of claim 1, wherein the torsion spring is coupled to a peg on the rear cover and applies a force to a rib on the rotational bracket to maintain the first rotational position.

4. The user device of claim 3, wherein the torsion spring to return the rotational bracket to the first rotational position upon the magnetic tool being removed from proximity to the front cover of the user device.

5. A user device comprising:

a front cover;

a rear cover, wherein the front cover and the rear cover define an interior space of the user device; and a magnetic locking device operatively coupled to the user device within the interior space of the user device to prevent unintentional separation of the front cover and the rear cover, the internal magnetic locking device to engage the front cover and the rear cover to prevent unintentional separation, wherein the internal magnetic locking device is rotatable between a first rotational position and a second rotational position, wherein the front cover and the rear cover are locked together in the first rotational position and unlocked in the second rotational position, wherein the internal magnetic locking device is configured to disengage the front cover and the rear cover upon application of an external magnetic force; and wherein a compression spring coupled to the internal magnetic locking device to maintain a distance between the internal magnetic locking device and one of the front cover and the rear cover.

6. The user device of claim 5, wherein the magnetic locking device comprises:

a rotational bracket coupled to one or more of the front cover and the rear cover, the rotational bracket comprising a locking tab to engage a locking edge of an other of the front cover and the rear cover.

7. The user device of claim 6, wherein the magnetic locking device further comprises:

a shoulder screw to couple the rotational bracket to the one of the front cover and the rear cover, the rotational bracket to rotate around the shoulder screw.

8. The user device of claim 6, wherein the magnetic locking device further comprises:

a torsion spring to cause the rotational bracket to be held at the first rotational position, wherein the locking tab overhangs the locking edge in the first rotational position.

9. The user device of claim 8, wherein the torsion spring is coupled to a peg on the one of the front cover and the rear cover and applies a force to a rib on the rotational bracket to maintain the first rotational position.

10. The user device of claim 9, wherein the external magnetic force, when applied by a magnetic tool, causes the rotational bracket to overcome the force applied by the torsion spring, causing the rotational bracket to rotate to the second rotational position, wherein the locking tab does not overhang the locking edge in the second rotational position.

11. The apparatus of claim 10, wherein the torsion spring to return the rotational bracket to the first rotational position upon the magnetic tool being removed from proximity to the other of the front cover and the rear cover of the user device.

12. An apparatus comprising:

a user device comprising a front cover and a rear cover, wherein the front cover and the rear cover define an interior space of the user device; and a locking device operatively coupled to the user device within the interior space of the user device to prevent unintentional separation of the front cover and the rear cover, the locking device comprising:

a rotational bracket coupled to the rear cover, the rotational bracket comprising a locking tab to overhang a locking edge of the front cover, wherein the rotational bracket is rotatable between a first rotational position and a second rotational position, wherein the front cover and the rear cover are locked together in the first rotational position and unlocked in the second rotational position;

a compression spring to cause a distance to be maintained between the rotational bracket and the rear cover; and a torsion spring to cause the rotational bracket to be held at the first rotational position, wherein the locking tab overhangs the locking edge in the first rotational position.

13. The apparatus of claim 12, wherein the locking device further comprises:

a shoulder screw to couple the rotational bracket to the rear cover, the rotational bracket to rotate around the shoulder screw.

14. The apparatus of claim 12, wherein the torsion spring is coupled to a peg on the rear cover and applies a force to a rib on the rotational bracket to maintain the first rotational position.

15. The apparatus of claim 14, wherein the locking device further comprises:

a magnet coupled to the rotational bracket, the magnet to magnetically couple with a magnetic tool in proximity to the front cover of the user device.

16. The apparatus of claim 15, wherein the magnetic tool to rotate the rotational bracket, overcoming the force applied by the torsion spring, to the second rotational position, wherein the locking tab does not overhang the locking edge in the second rotational position.

17. The apparatus of claim 16, wherein the torsion spring to return the rotational bracket to the first rotational position upon the magnetic tool being removed from proximity to the front cover of the user device.

* * * * *